US010188184B2

(12) United States Patent
Wong et al.

(10) Patent No.: US 10,188,184 B2
(45) Date of Patent: Jan. 29, 2019

(54) FOLDING SUITCASE

(71) Applicant: VOYLUX COMPANY LIMITED, Kwai Chung (HK)

(72) Inventors: Wai-Ming Wong, Kwai Chung (HK); Hung-Sheng Lin, Kwai Chung (HK)

(73) Assignee: VOYLUX COMPANY LIMITED, Kwai Chung (HK)

( * ) Notice: Subject to any disclaimer, the term of this patent is extended or adjusted under 35 U.S.C. 154(b) by 31 days.

(21) Appl. No.: 14/738,394

(22) Filed: Jun. 12, 2015

(65) Prior Publication Data

US 2016/0213110 A1 Jul. 28, 2016

(30) Foreign Application Priority Data

Jan. 23, 2015 (TW) ..... 104201180 U

(51) Int. Cl.

| | |
|---|---|
| ***A45C 7/00*** | (2006.01) |
| ***A45C 5/03*** | (2006.01) |
| *A45C 13/00* | (2006.01) |
| *A45C 13/10* | (2006.01) |

(52) U.S. Cl.

CPC ..... *A45C 5/03* (2013.01); *A45C 7/0036* (2013.01); *A45C 13/005* (2013.01); *A45C 13/103* (2013.01); *A45C 2005/035* (2013.01)

(58) Field of Classification Search

CPC ... A45C 7/0022; A45C 7/0036; A45C 7/0063; A45C 7/0077; A45C 7/0086

USPC ..... 190/107, 1; 220/9.2, 9.3, 7; 383/104

See application file for complete search history.

(56) References Cited

U.S. PATENT DOCUMENTS

| | | | | |
|---|---|---|---|---|
| 3,730,308 A * | 5/1973 | Pelavin | A45C 3/001 190/115 |
| 4,160,496 A * | 7/1979 | Knight | A45C 7/0036 190/107 |
| 4,610,334 A * | 9/1986 | Pelavin | A45C 3/001 190/122 |
| 7,014,057 B2 * | 3/2006 | Wang | B65D 5/3614 220/4.29 |

(Continued)

FOREIGN PATENT DOCUMENTS

| | | | |
|---|---|---|---|
| GB | 1358662 | * | 7/1974 |
| TW | M471788 | * | 2/2014 |
| WO | WO 2014/127497 A1 | * | 8/2014 |

*Primary Examiner* — Sue A Weaver
(74) *Attorney, Agent, or Firm* — Maschoff Brennan

(57) ABSTRACT

A folding suitcase includes a back case component, a front lid component, a peripheral side wall component, and a fold-resisting component. An accommodating space formed by the peripheral side wall component, the back case component and the front lid component is for being covered selectively. The peripheral side wall component has multiple first sidewall parts, multiple second sidewall parts and multiple bending parts connected to the multiple sidewall parts and the multiple second sidewall parts. The multiple bending parts are bendable to allow the multiple first sidewall parts and the multiple second sidewall parts to be folded oppositely or erected on the back case component. The fold-resisting component is elastic and includes a combined part and an extension part. The combined part is disposed at the multiple first sidewall parts. The extension part is detachably disposed at the multiple bending parts for selectively supporting the peripheral side wall component.

9 Claims, 12 Drawing Sheets

(56) References Cited

U.S. PATENT DOCUMENTS

| | | | | |
|---|---|---|---|---|
| 7,175,010 | B1 * | 2/2007 | Miner | A45C 7/0036<br>190/107 |
| 2005/0034948 | A1 * | 2/2005 | Tiramani | A45C 7/0036<br>190/107 |
| 2014/0339227 | A1 * | 11/2014 | Chalifoux | B65D 5/3692<br>220/7 |

* cited by examiner

FOLDING SUITCASE

CROSS-REFERENCE TO RELATED APPLICATIONS

This non-provisional application claims priority under 35 U.S.C. § 119(a) on Patent Application No(s). 104201180 filed in Taiwan, R.O.C. on Jan. 23, 2015, the entire contents of which are hereby incorporated by reference.

BACKGROUND

Technical Field

The disclosure relates to a suitcase. More particularly, the disclosure relates to a folding suitcase.

Background

When traveling, users need suitcases for accommodating necessities and souvenirs. Types of the suitcases can be divided into carry-on suitcases (about 16 to 20 linear inches), medium suitcases (about 22 to 26 linear inches), or large suitcases (about 27 to 30 linear inches) according to their sizes. The users usually choose certain suitcases with different sizes according to the span of their travel. For example, the users may bring carry-on suitcases when they have 3-to-5-day travel. Moreover, the users may bring medium suitcases when they have 5-to-7-day travel. Furthermore, the users may bring large suitcases when they travel for many days.

SUMMARY

One aspect of the disclosure provides a folding suitcase, which includes a back case component, a front lid component, a peripheral side wall component, and at least one fold-resisting component. The peripheral side wall component has two sides which are opposite to each other. An edge of the back case component and an edge of the front lid component are connected to the two sides of the peripheral side wall component respectively, thereby forming an accommodating space which is for being covered selectively. The peripheral side wall component has a plurality of first sidewall parts, a plurality of second sidewall parts and a plurality of bending parts connected to the plurality of first sidewall parts and the plurality of second sidewall parts. The plurality of bending parts is bendable to allow the plurality of first sidewall parts and the plurality of second sidewall parts to be folded oppositely or to be erected on the back case component. The fold-resisting component is elastic and includes a combined part and an extension part which are connected to each other. The combined part is disposed at the plurality of first sidewall parts. The extension part is detachably disposed at the plurality of bending parts for selectively supporting the peripheral side wall component.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
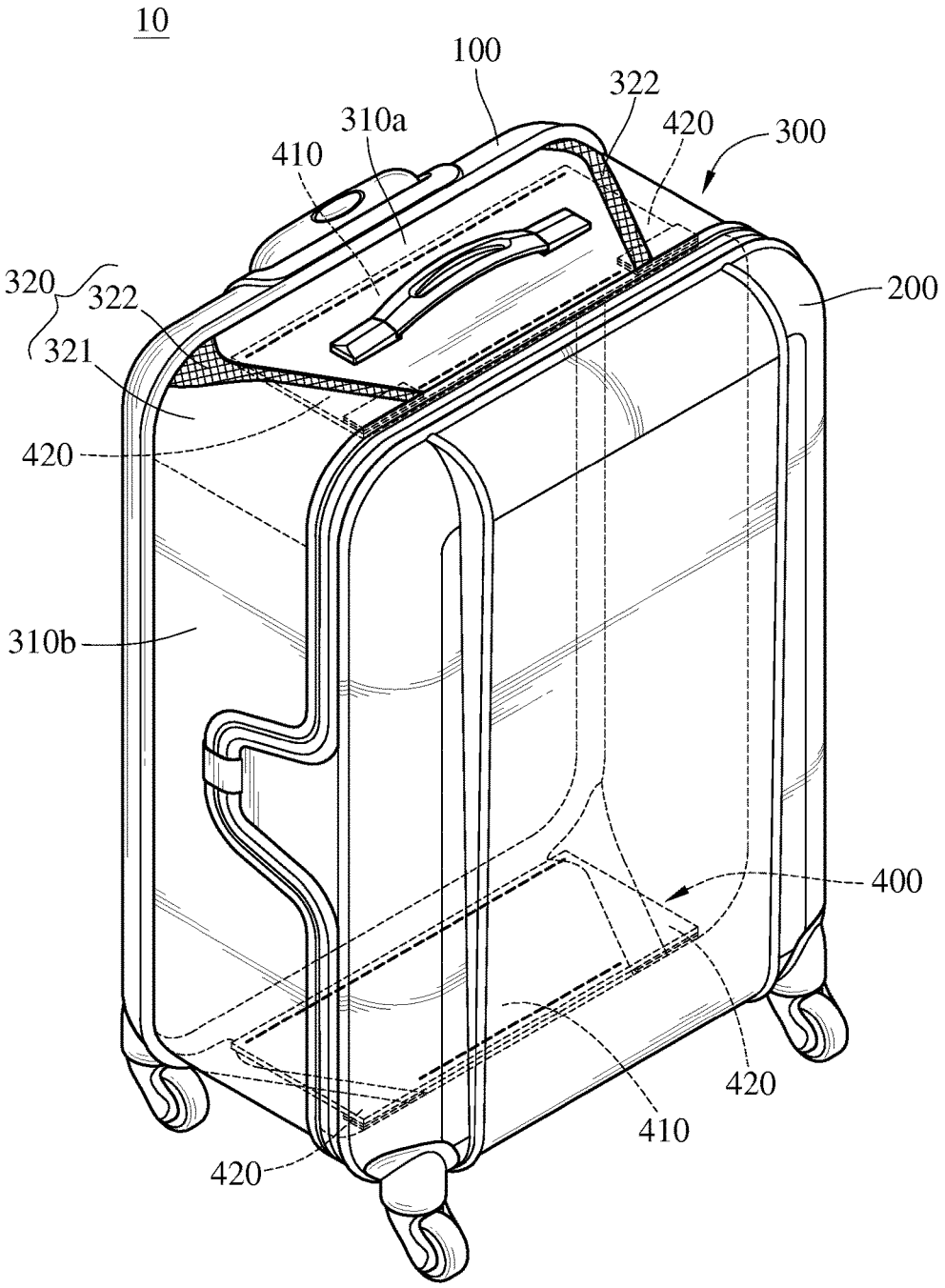
FIG. 1 is a perspective view of a folding suitcase according to a first embodiment of the disclosure.
Figure 2:
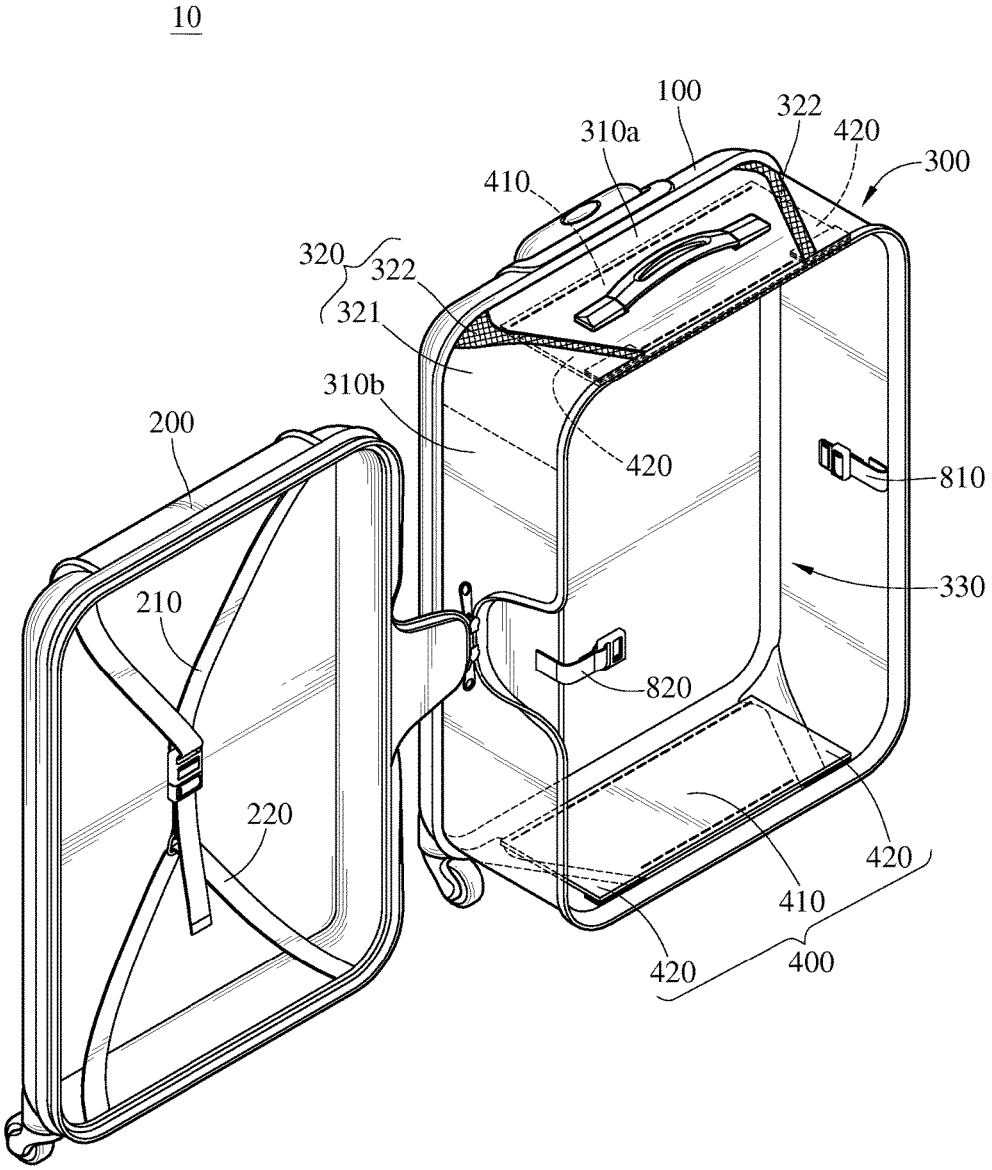
FIG. 2 is a perspective view of the folding suitcase in FIG. 1 when the folding suitcase is opened.

Please refer to FIG. 1 and FIG. 2. FIG. 1 is a perspective view of a folding suitcase according to a first embodiment of the disclosure. FIG. 2 is a perspective view of the folding suitcase in FIG. 1 when the folding suitcase is opened. In this embodiment, the folding suitcase 10 includes a back case component 100, a front lid component 200, a peripheral side wall component 300 and two fold-resisting components 400.

The front lid component 200 has two storage belts 210 and 220. The two storage belts 210 and 220 are able to be buckled with each other.

The peripheral side wall component 300 has two sides which are opposite to each other. The back case component 100 and the front lid component 200 are connected to the two sides of the peripheral side wall component 300 respectively, thereby forming an accommodating space 330 which is able to be covered selectively by the front lid component 200. Specifically, in this embodiment, one of the two sides of the peripheral side wall component 300 and the back case component 100 are sewn together, and the other side of the peripheral side wall component 300 and the front lid component 200 are joined together by a zipper. When the zipper is zipped up (as shown in FIG. 1), the front lid component 200 covers the accommodating space 330. When the zipper is unzipped (as shown in FIG. 2), the front lid component 200 is opened, so that the accommodating space 330 is exposed. The disclosure is not limited to the above-mentioned configuration. In other embodiments, for example, the two sides of the peripheral side wall component 300 are joined to the back case component 100 and the front lid component 200 by two zippers, respectively.

Furthermore, the back case component 100 and the front lid component 200 are, but not limited to, made of plastic plates, such as, polyethylene (PE), polypropylene (PP), polycarbonate (PC), ethylene-vinyl acetate (EVA), polyvinyl chloride (PVC) or acrylonitrile butadiene styrene (ABS) resin.

In this embodiment, the peripheral side wall component 300 is made from composite materials, such as relatively harder materials (cloth, PE, PVC, PP, PC, EVA or ABS resin) and relatively softer materials (cane cloth, styrene-butadiene rubber (SBR), jersey (150 Denier), polyurethane (PU), rubber, thermoplastic polyurethane (TPU), sandwich mesh fabric, neoprene, polyester fabric, thermoplastic rubbers (TPR), webbing, or leather). Specifically, the peripheral side wall component 300 includes a plurality of first sidewall parts 310*a*, a plurality of second sidewall parts 310*b* and a plurality of bending parts 320 connecting the plurality of first sidewall parts 310*a* and the plurality of second sidewall parts 310*b*. The bending parts 320 are bendable to allow the plurality of sidewall parts 310 to be folded oppositely or to be erected on the back case component 100. The first sidewall parts 310*a* and the second sidewall parts 310*b* being folded (namely, stacked or overlapped) oppositely means that inner wall surfaces of first sidewall parts 310*a* and inner wall surfaces of the second sidewall parts 310*b* are folded on the back case component 100. The first sidewall parts 310*a* and the second sidewall parts 310*b* being erected means that the first sidewall parts 310*a* and the second sidewall parts 310*b* are substantially perpendicular to the back case component 100. In other words, a part of the peripheral side wall component 300 generating fold lines or deformations are defined as the bending parts 320 during a folding process. Oppositely, the rest of the peripheral side wall component 300 is defined as the first sidewall parts 310*a* and the second sidewall parts 310*b*.

Each first sidewall part 310*a* and each second sidewall part 310*b* is, but not limited to, made of a cloth layer (1682 Denier) with PU bottom, an EVA layer, and a PP plate layer, respectively. Each bending part 320 has a link-up section 321 and a bending section 322 which are connected to each other. The bending sections 322 are connected to the first sidewall parts 310*a*, and the link-up sections 321 are connected to the second sidewall parts 310*b*. The materials of the link-up sections 321 are the same as the first sidewall parts 310*a* and the second sidewall parts 310*b*. In other words, the link-up sections 321 are, but not limited to, made of a cloth (1682 Denier) layer with PU bottom, an EVA layer, and a PP plate layer. The bending sections 322 are, but not limited to, made of a cane cloth layer, a SBR layer, and a jersey (150 Denier) layer. The ability of the bending section 322 to bend and deform is better than that of the link-up section 321. For example, the cane cloth layer is made from SBR. The abilities of the cane cloth layer, the SBR layer and the jersey (150 Denier) layer to bend and deform are better than those of the cloth (1682 Denier) layer's with PU bottom, the EVA layer's and the PP plate layer. Additionally, the cane cloth layer, the SBR layer and the jersey (150 Denier) layer are bendable. Accordingly, the first sidewall parts 310*a* and the second sidewall parts 310*b* are driven to be folded on the back case component 100 when the bending parts 320 are bent.

In this and some embodiments, widths of the bending section 322 are gradually decreased from a side near the back case component 100 toward the front lid component 200, for matching with the position of the fold line of the bending part 320. Thus, the peripheral side wall component 300 is able to be bent easily. However, in other embodiments, the widths of the bending section 322 are consistent.

Furthermore, in this and some embodiments, a width of a side of each first sidewall part 310*a* near the back case component 100 is greater than a width of another side of each first sidewall part 310*a* away from the back case component 100. However, in other embodiments, the widths of each first sidewall part 310*a* are consistent.

As shown in FIG. 2, the two fold-resisting components 400 are elastic. Each fold-resisting component 400 includes a combined part 410 and two extension parts 420. The combined part 410 has two sides which are opposite to each other, and the two extension parts 420 are connected to the two sides of the combined part 410, respectively. The combined part 410 is disposed on the first sidewall parts 310*a*. The two extension parts 420 are detachably disposed on the two link-up sections 321 for selectively supporting the peripheral side wall component 300.

In this embodiment, the quantity of the extension parts 420 is two. However, in other embodiments (not shown in figures), for example, the quantity of the extension part 420 is one and located on one side of the combined part 410.

Figure 3:
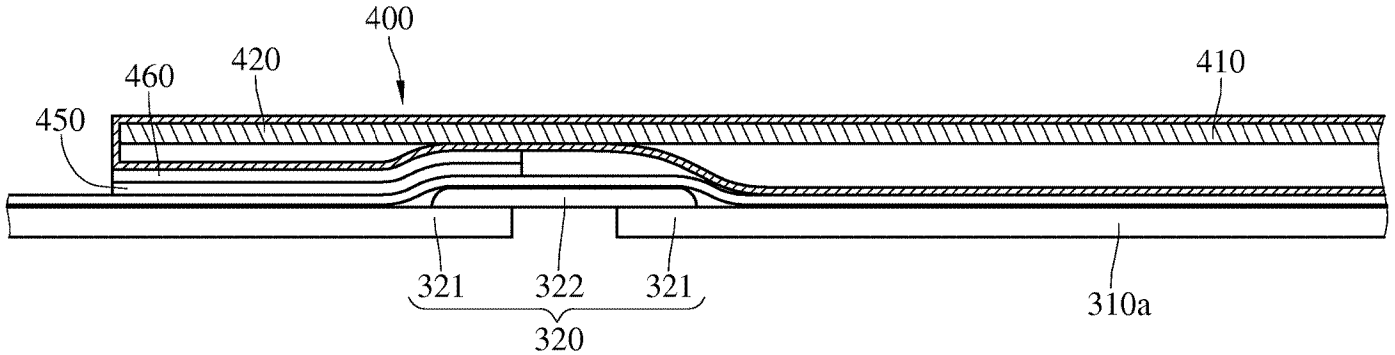
FIG. 3 is a partially sectional view of an extension part of a fold-resisting component and a link-up section of a bending part in FIG. 2 when the extension part is attached to the link-up section.
Figure 4:
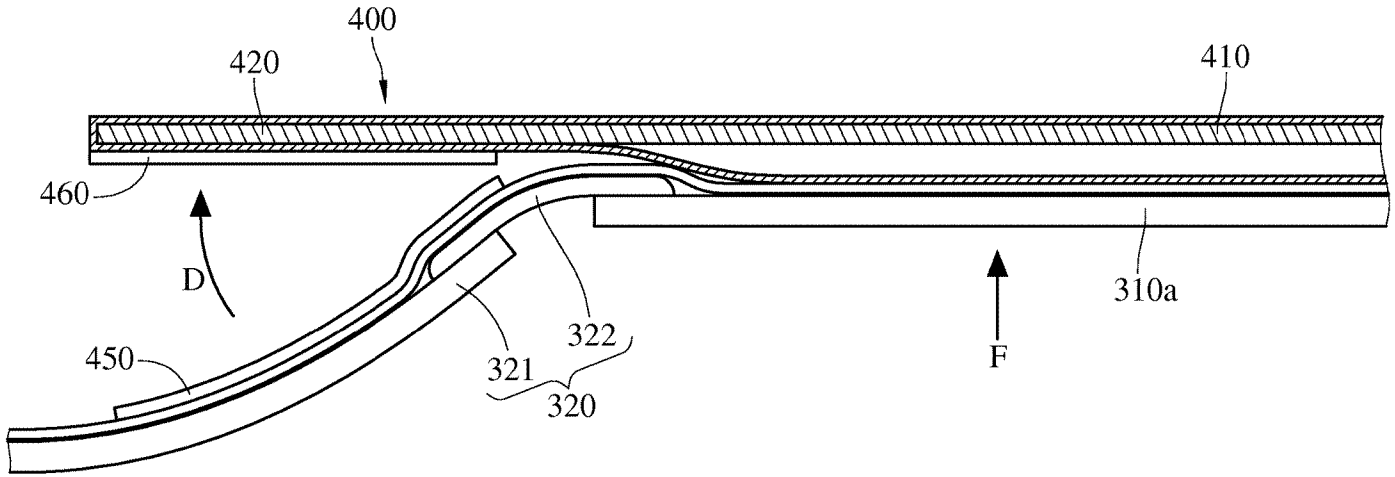
FIG. 4 is a partially sectional view of the extension part and the link-up section in FIG. 3 when the extension part is separated from the link-up section.

Please refer to FIG. 2 through FIG. 4. FIG. 3 is a partially sectional view of an extension part of a fold-resisting component and a link-up section of a bending part in FIG. 2 when the extension part is attached to the link-up section. FIG. 4 is a partially sectional view of the extension part and the link-up section in FIG. 3 when the extension part is separated from the link-up section. As shown in FIG. 2, in this embodiment, the combined part 410 of the fold-resisting component 400 is sewn on the first sidewall part 310*a*, and the extension part 420 is not sewn on the bending part 320. Thus, the extension part 420 of the fold-resisting component 400 is able to move relative to the peripheral side wall component 300.

As shown in FIG. 3 and FIG. 4, in this embodiment, the folding suitcase 10 further includes a first combination component 450 and a second combination component 460. The extension part 420 of the fold-resisting component 400 is detachable combined with the link-up section 321 of the bending part 320 by the first combination component 450 and the second combination component 460. Specifically, the first combination component 450 and the second combination component 460 are two attached components with hooks and loops (such as Velcro®). The first combination component 450 is disposed on the link-up section 321 of the bending part 320, and the second combination component 460 is disposed on the extension part 420 of the fold-resisting component 400. The first combination component 450 is detachably attached to the second combination component 460. As shown in FIG. 3, when the first combination component 450 is attached to the second combination component 460, the extension part 420 of the fold-resisting component 400 is fixed to the link-up section 321 of the bending part 320, for supporting the peripheral side wall component 300. In other words, the first sidewall part 310*a* and the bending section 322 of the bending part 320 are limited and driven to be expanded by the elasticity of the fold-resisting component 400, such that the folding suitcase 10 is maintained to be unfolded.

As shown in FIG. 4, when a user applies an external force F to the first sidewall part 310*a*, the second combination component 460 is driven to be separated from the first combination component 450. Additionally, the extension part 420 of the fold-resisting component 400 is separated from the link-up section 321 of the bending part 320 along a direction indicated by an arrow D. At this time, the peripheral side wall component 300 is not supported by the fold-resisting component 400 and able to be folded. Namely, the first sidewall part 310*a* and the bending part 320 are able to be folded without the support and limitation of the fold-resisting component 400. Thus, the first sidewall part 310*a* is bent relative to the back case component 100 due to the elasticity of the bending section 322 of the bending part 320.

In this embodiment, the first combination component 450 and the second combination component 460 are two attached components with hooks and loops (such as Velcro®). The disclosure is not limited to the above-mentioned configuration. In other embodiments, for example, the first combination component 450 and the second combination component 460 are buttons or zippers. However, the attached components with hooks and loops are easily attached to each other. The folding suitcase 10 that is folded or opened with attached components with hooks and loops is described hereinafter.

Furthermore, in this embodiment, the folding suitcase 10 further includes a first belt 810 and a second belt 820. The first belt 810 and the second belt 820 are disposed at the two second sidewall parts 310*b* which are opposite to each other, respectively. The first belt 810 and the second belt 820 are able to be buckled to each other.

Figure 5:
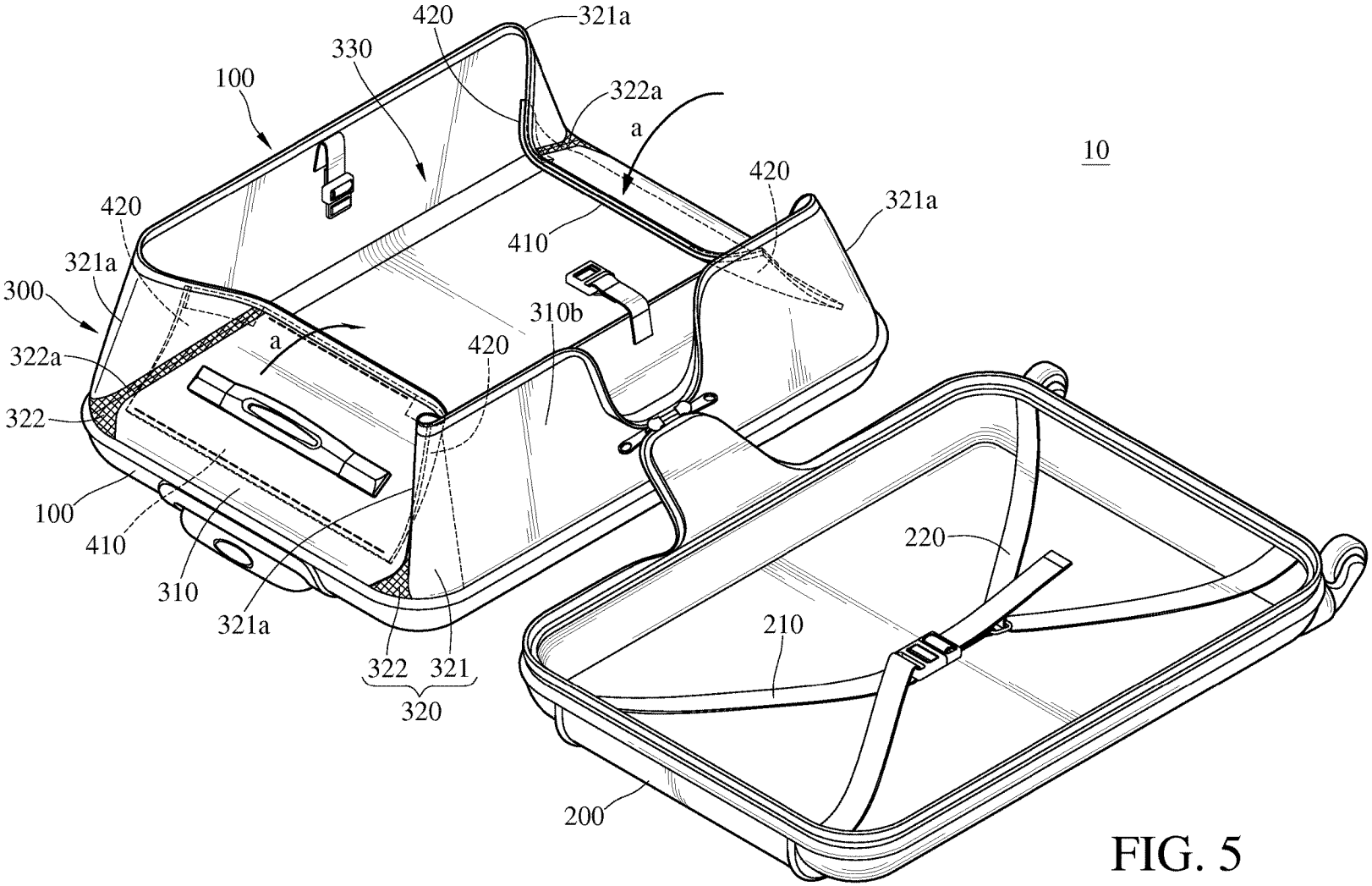
FIG. 5 through FIG. 8 are perspective views of the folding suitcase in FIG. 2 during different steps of a folding process of the suitcase.
Figure 7:
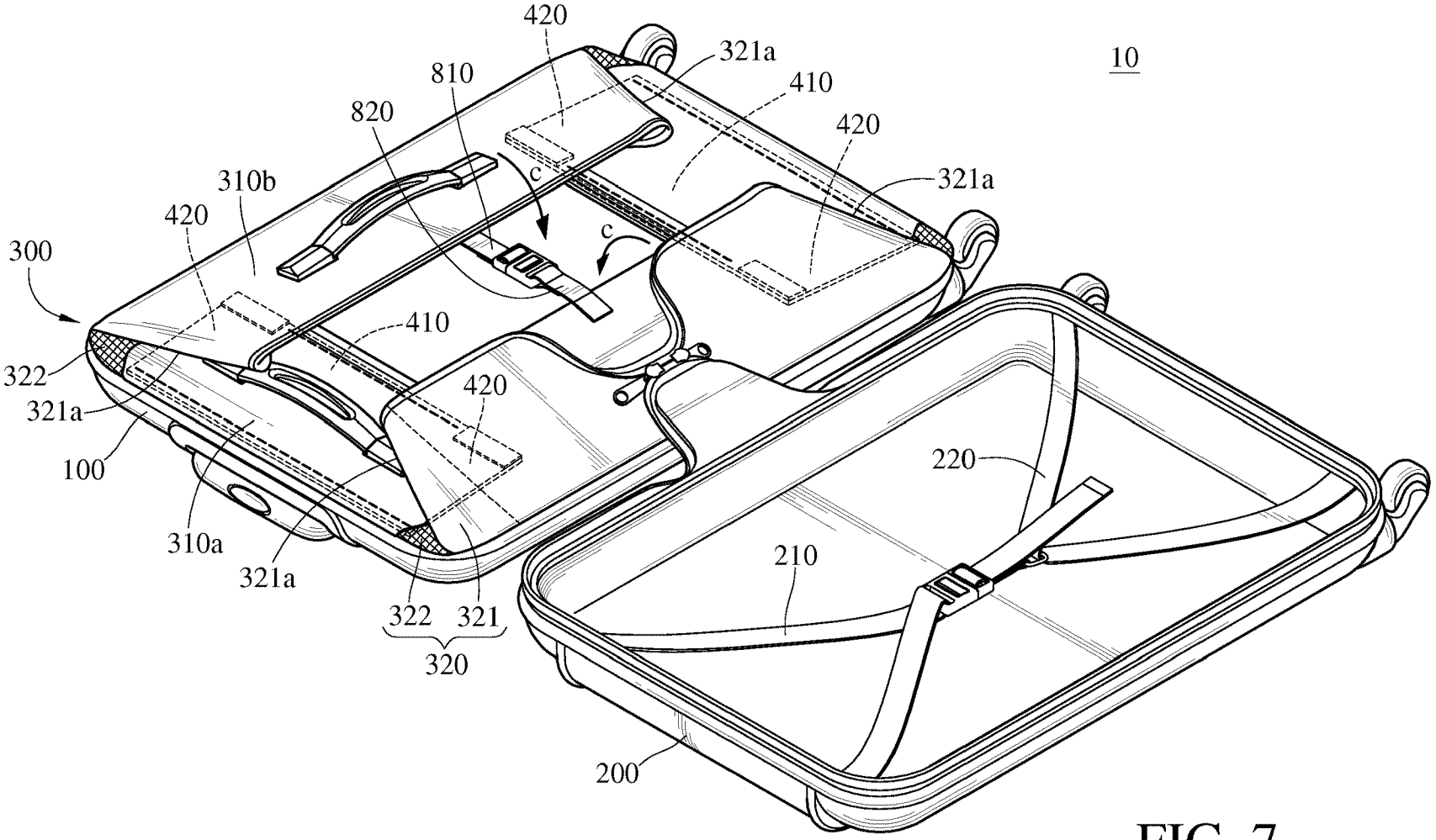
Figure 8:
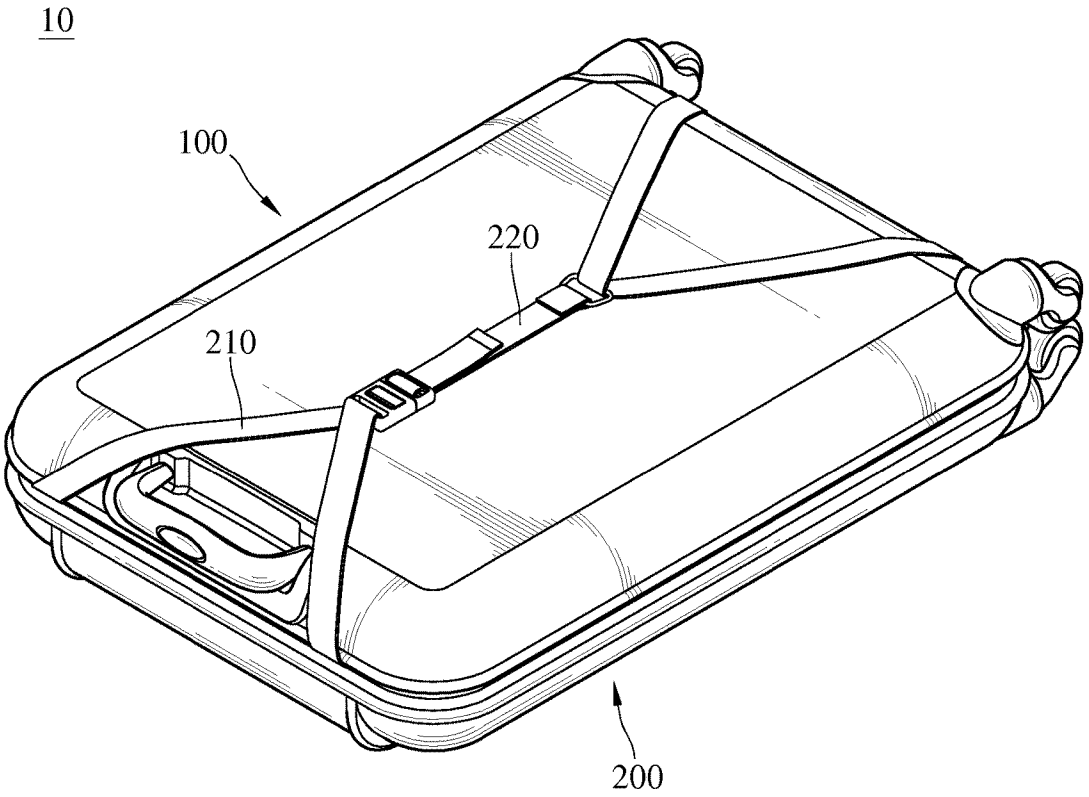
Figure 9:
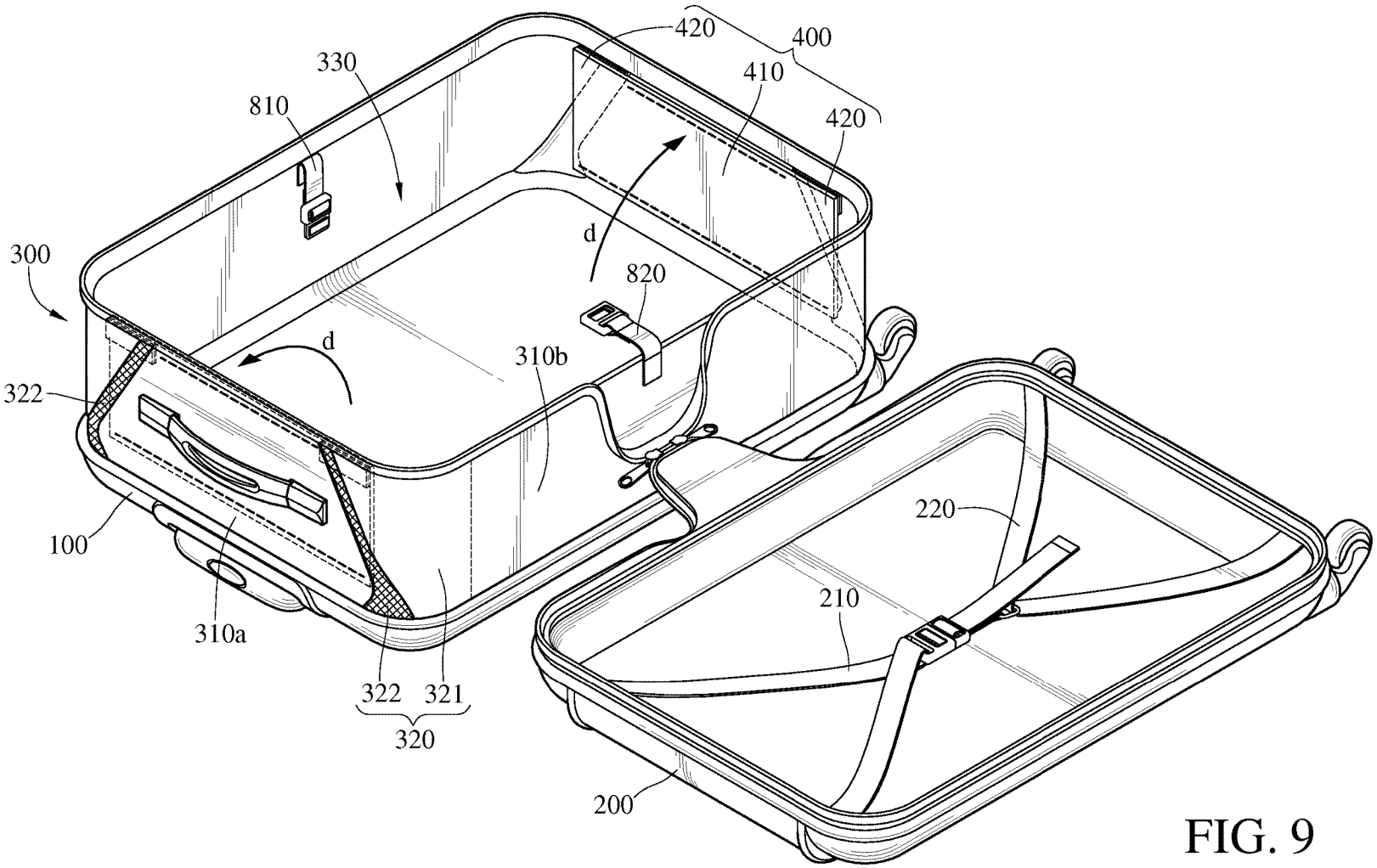
FIG. 9 is a perspective view of the folding suitcase in FIG. 2 when the folding suitcase is opened.

Please refer to FIG. 5 through FIG. 9. FIG. 5 through FIG. 8 are perspective views of the folding suitcase in FIG. 2 during different steps of a folding process of the suitcase. FIG. 9 is a perspective view of the folding suitcase in FIG. 2 when the folding suitcase is opened. As shown in FIG. 5, the two first sidewall parts 310*a* are pressed inward along a direction indicated by an arrow a first. Then, the two second sidewall parts 310*b* are driven to be bent relative to the back case component 100 by the two first sidewall parts 310*a*, and fold lines 321*a* and 322*a* are formed on the link-up section 321 and the bending section 322 of the bending part 320, respectively. When the link-up section 321 is bent relative to the bending section 322 of the bending part 320, an included angle formed between the first sidewall part 310*a* and the link-up section 321 is less than 180 degrees, and the fold-resisting component 400 stores an elastic potential energy. Since the peripheral side wall component 300 is bent slightly and the elastic potential energy of the fold-resisting component 400 is less than a combination force between the first combination component 450 and the second combination component 460 (as shown in FIG. 4), the extension part 420 of the fold-resisting component 400 is still fixed to the link-up section 321 of the bending part 320. Accordingly, the extension part 420 still supports the peripheral side wall component 300 to cause the peripheral side wall component 300 to be unfolded.

Figure 6:
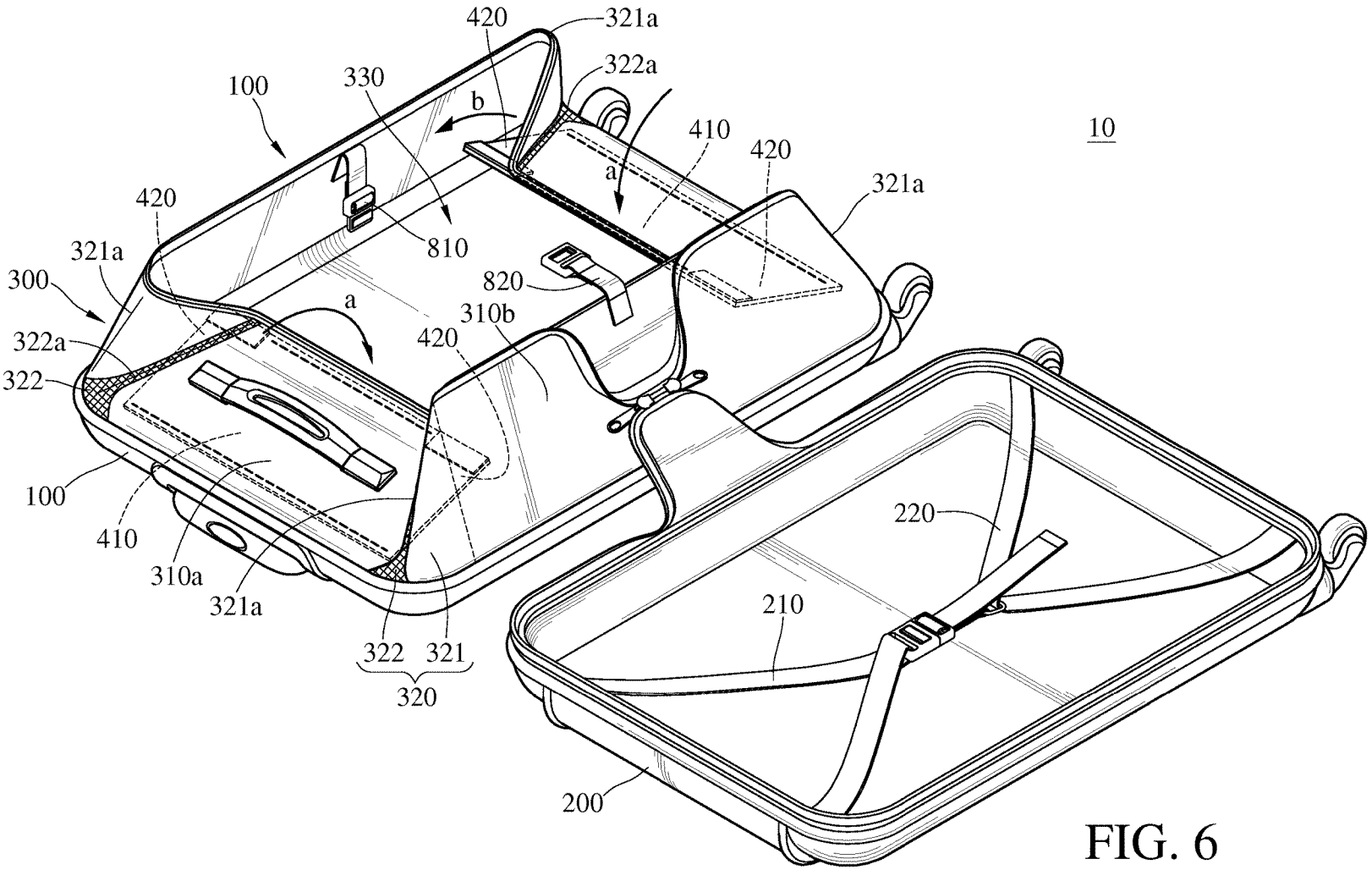

As shown in FIG. 6, the two first sidewall parts 310*a* are pressed inward along the direction indicated by the arrow a continuously. At this moment, the elastic potential energy of the fold-resisting component 400 is greater than the combination force between the first combination component 450 and the second combination component 460, so the extension part 420 of the fold-resisting component 400 is separated from the link-up section 321 of the bending part 320 along a direction indicated by an arrow b. In other words, the peripheral side wall component 300 is easily folded and stacked on the back case component 100 without the support (or limitation) of the fold-resisting component 400.

Then, as shown in FIG. 7, the two second sidewall parts 310*b* are pressed along a direction indicated by an arrow c and totally stacked on the back case component 100. Moreover, the first belt 810 is buckled with the second belt 820, and all the sidewall parts 310 are tightly folded by the first belt 810 and the second belt 820.

Then, as shown in FIG. 8, the storage belts 210 and 220 are buckled with each other, and the back case component 100 and the peripheral side wall component 300 are limited by the storage belts 210 and 220 and located between the front lid component 200 and the storage belts 210 and 220.

As shown in FIG. 9, when the first belt 810 and the second belt 820 are unbuckled, the user is able to press the first sidewall part 310*a* and the second sidewall part 310*b* to erect (namely, stand) on the back case component 100 again. When the first sidewall part 310*a* and the second sidewall part 310*b* stand on the back case component 100, the second combination component 460 of the extension part 420 of the fold-resisting component 400 is attached to the first combination component 450 of the link-up section 321 of the bending part 320 at the same time (as shown in FIG. 3). Additionally, the first sidewall part 310*a* and the second sidewall part 310*b* are supported by the elasticity of the fold-resisting component 400 again. Thus, the bending sections 322 of the first sidewall part 310*a* and the bending part 320 are expanded to allow the peripheral side wall component 300 to stand on the back case component 100 again.

As above-mentioned, the peripheral side wall component 300 is simultaneously driven to erect by the elasticity of the fold-resisting component 400. Specifically, even when the folding suitcase 10 is folded after a long period of time, the user is able to unfold the folding suitcase 10 easily due to the elasticity of the fold-resisting component 400 as shown in FIG. 9.

Figure 10:
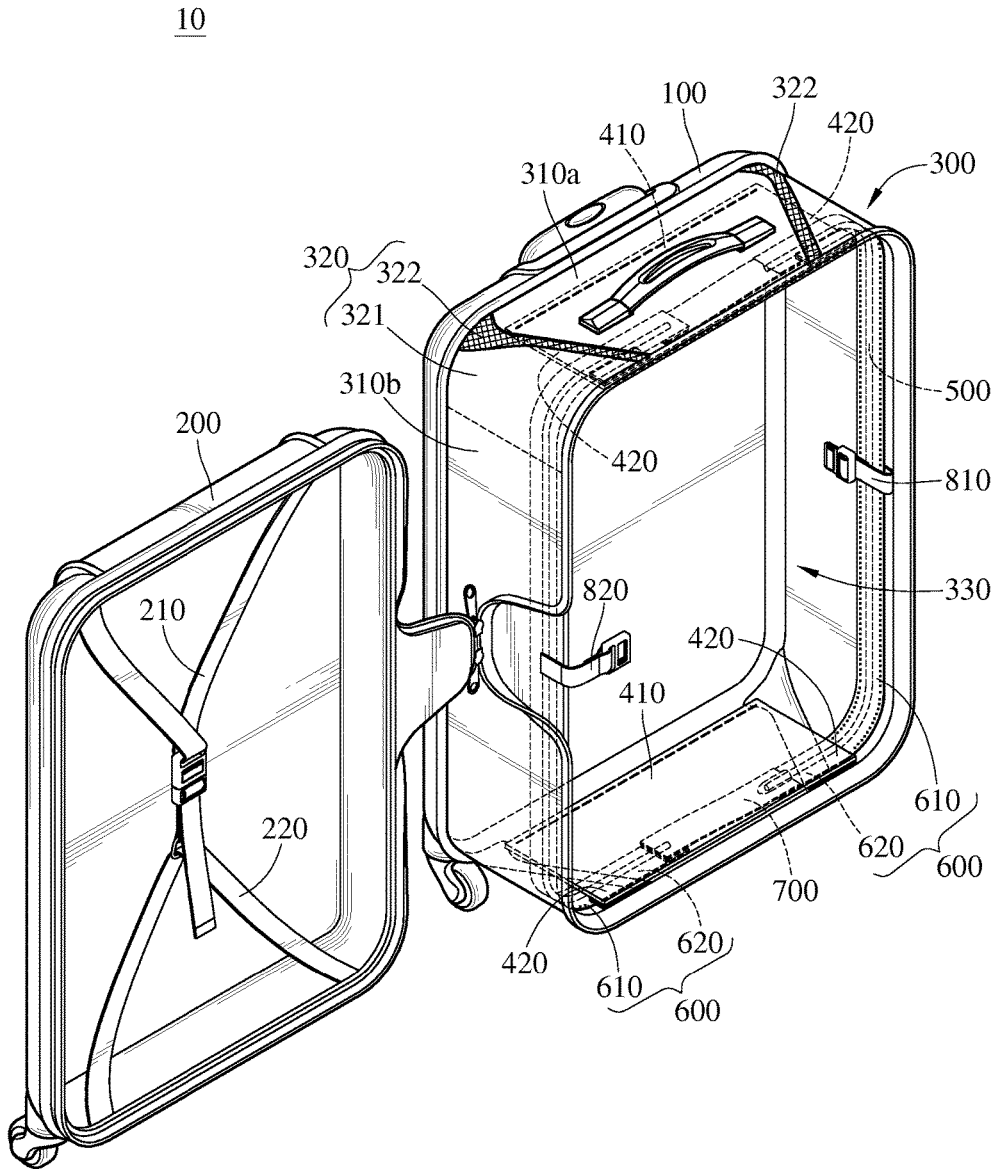
FIG. 10 is a perspective view of a folding suitcase according to a second embodiment of the disclosure.
Figure 11:
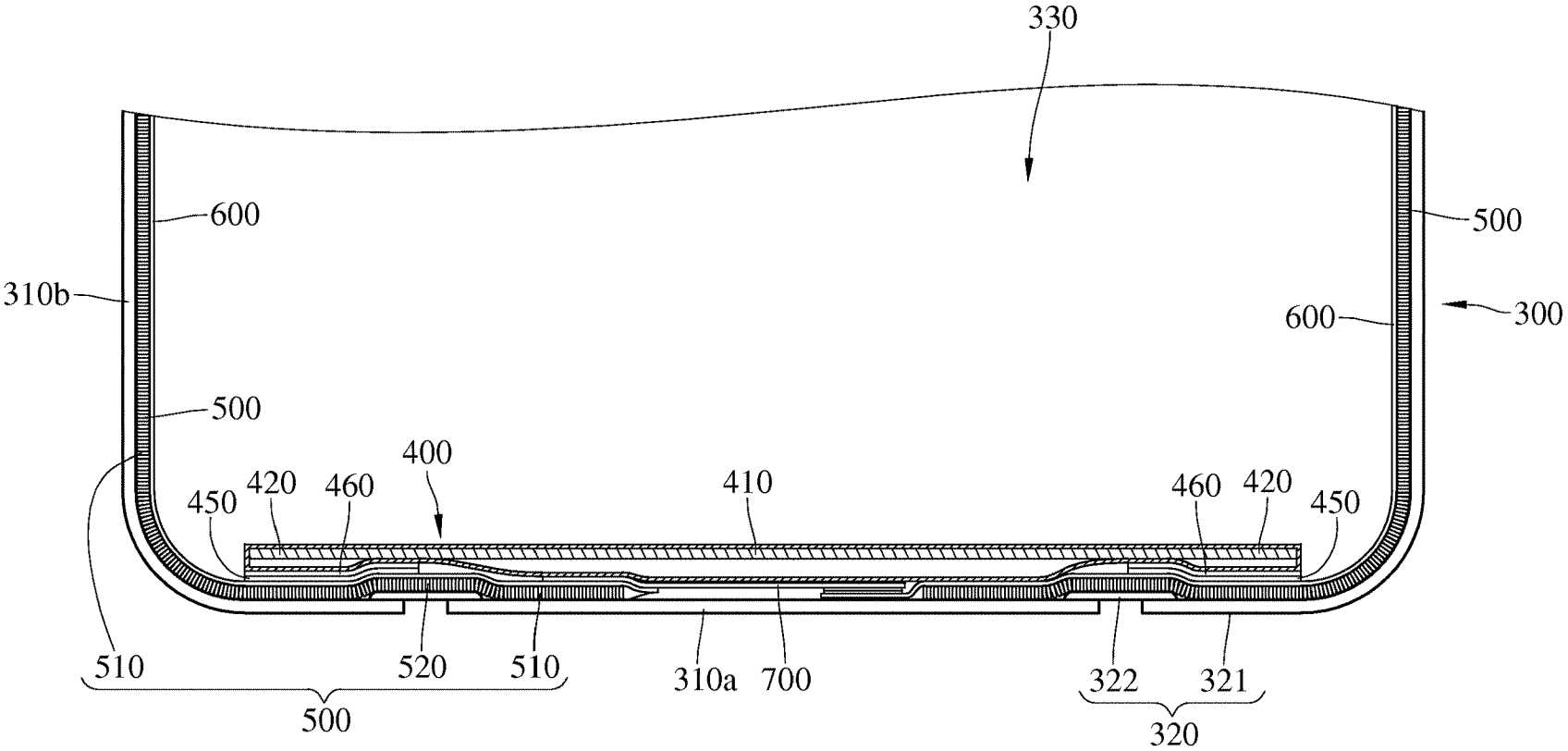
FIG. 11 is a partially sectional view of the folding suitcase in FIG. 10.
Figure 12:
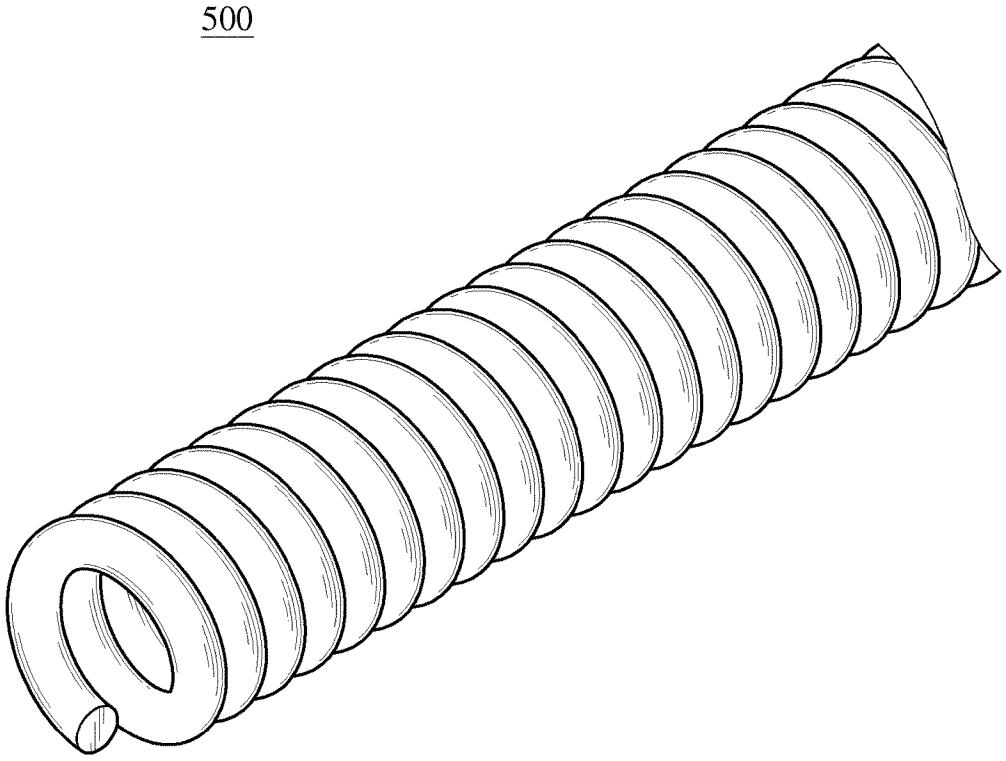
FIG. 12 is a perspective view of a restoring component in FIG. 10.

Please refer to FIG. 10 through FIG. 12. FIG. 10 is a perspective view of a folding suitcase according to a second embodiment of the disclosure. FIG. 11 is a partially sectional view of the folding suitcase in FIG. 10. FIG. 12 is a perspective view of a restoring component in FIG. 10. As shown in FIG. 10, the folding suitcase 10' further includes two restoring components 500, two bendable fixing components 600 and two elastic components 700. The two restoring components 500 are located at an inner side of the peripheral side wall component 300 away from the back case component 100 by the two bendable fixing components 600. The bendable fixing components 600, for example, are cloth, elastic ribbon or nylon. Each bendable fixing component 600 has a fixing section 610 and a suspension section 620 which are connected with each other. The two fixing sections 610 are located on the peripheral side wall component 300. The elastic component 700 has two ends which are opposite to each other, and the two suspension sections 620 are connected to the two ends of the elastic component 700, respectively. The elastic component 700, for example, is an elastic ribbon. The fixing section 610, for example, is sewn on the peripheral side wall component 300. The suspension sections 620 are not fixed to the peripheral side wall component 300. The two suspension sections 620 connected to each other by the elastic component 700 are for providing a spare space for contortions of the restoring component 500. Additionally, the elastic component 700 is for applying an elastic force to the two suspension sections 620 to restore to its original position.

To assemble the elastic component 700 more conveniently, in this embodiment, one end of the elastic component 700 is sewn on one of the suspension sections 620, and the other end of the elastic component 700 is fastened to the other suspension section 620 by Velcro®.

In this embodiment, for example, the restoring components 500 are located on the inner side of the peripheral side wall component 300. In other embodiments, the restoring components 500 are located on an outer side of the peripheral side wall component 300.

The quantity of the restoring components 500 is, but not limited to, two. Additionally, the two restoring components 500 surround the accommodating space 330, but the disclosure is not limited thereto. In other embodiments, the quantity of the restoring component 500 is one, and the only one restoring component 500 surrounds the accommodating space 330 singly.

In this embodiment, each restoring component 500 is disposed across at least one bending part 320. The restoring component 500 (such as a helical spring or an elastic strip) is elastic for erecting the first sidewall parts 310*a* and the second sidewall parts 310*b*. For example, the restoring component 500 is for erecting the first sidewall parts 310*a* and the second sidewall parts 310*b* at an upright position where the first sidewall parts 310*a* and the second sidewall parts 310*b* stand vertically on the back case component 100, from a non-upright position where the first sidewall parts 310*a* and the second sidewall parts 310*b* are not at the upright position. Accordingly, the elastic potential energy is generated by bending the helical spring in a lateral direction or tensioning the elastic strip, to drive the first sidewall parts 310*a* and the second sidewall parts 310*b* to be erected which were not upright. The lateral direction is perpendicular to the axial extension line of the restoring component 500.

Furthermore, as shown in FIG. 11 and FIG. 12, the restoring component 500 is a helical spring, and the shape of the restoring component 500 is cylindrical shape. Each restoring component 500 includes two connection sections 510 and an elastic contortion section 520. The elastic contortion section 520 has two sides which are opposite to each other, and the two connection sections 510 are connected with the two sides of the elastic contortion section 520, respectively. The two connection sections 510 are located on any two of the first sidewall parts 310*a* and any two of the second sidewall parts 310*b*, respectively. The elastic contortion section 520 is disposed across at least one bending part 320.

In this embodiment, the shape of the restoring component 500 is cylindrical shape. Accordingly, same values of elastic potential energies are generated in each direction by the lateral bending of the restoring component 500 and thus it can provide a stable restoration of the folding suitcase 10' by the restoring component 500.

Then, the restoring principle of the restoring component 500 is described as follows. The elastic contortion section 520 has a feature of elastic contortion. The elastic contortion means that the elastic contortion section 520 is able to be contorted by a force. When the force is removed, the elastic contortion section 520 is restored when the elastic contortion is still below a critical point of the elasticity of the elastic contortion section 520. In this embodiment, the first sidewall parts 310*a* and the second sidewall parts 310*b* are driven to be erected by the elastic contortion of the elastic contortion section 520.

Figure 13:
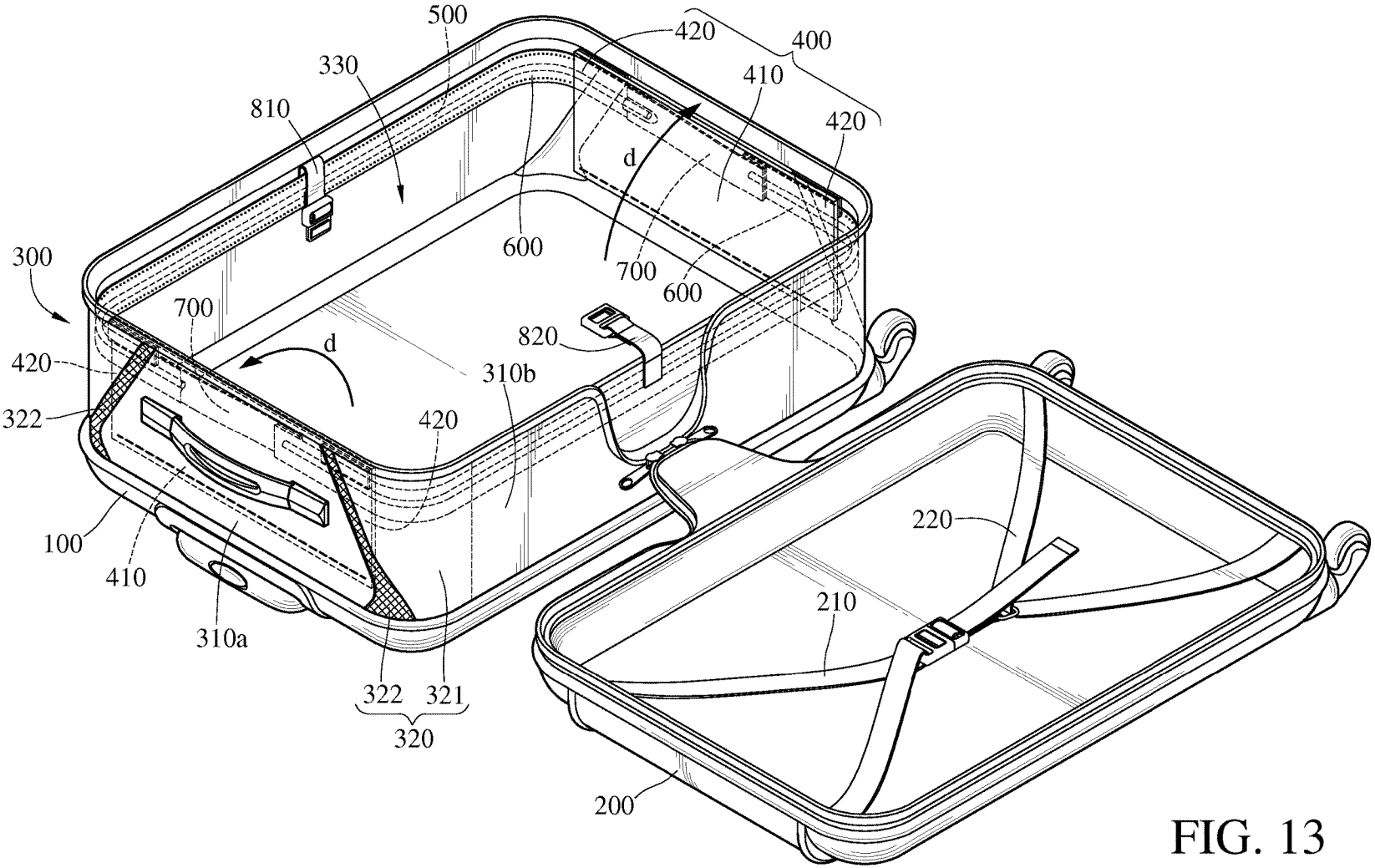
FIG. 13 is a perspective view of the folding suitcase in FIG. 10 when the folding suitcase is opened.

In this embodiment, the process of folding the folding suitcase 10' is similar to that of the folding suitcase 10 according to the first embodiment in FIG. 1, such that only the differences between the second embodiment and the first embodiment will be described as follows. Please refer to FIG. 13 which is a perspective view of the folding suitcase in FIG. 10 when the folding suitcase is opened.

Compared with the first embodiment in FIG. 1, in this embodiment, since the folding suitcase 10' includes the restoring component 500, the first sidewall parts 310*a* and the second sidewall parts 310*b* are restored automatically when the user unbuckles the first belt 810 and the second belt 820. Namely, the first sidewall parts 310*a* and the second sidewall parts 310*b* are able to stand on the back case component 100 automatically due to the elastic potential energy of the restoring component 500. Thus, the folding suitcase 10' is able to be unfolded easily and conveniently.

According to the folding suitcase of the disclosure, the combined part of the fold-resisting component is combined with the first sidewall part, and the extension part of the fold-resisting component is detachably combined with the bending part. Since the extension part is able to be combined with or separated from the link-up section of the bending part, the fold-resisting component is able to support the peripheral side wall component selectively. When the extension part is combined with the link-up section of the bending part, the peripheral side wall component is supported by the fold-resisting component to be uneasily folded. When the fold-resisting component is separated from the link-up section of the bending part, the peripheral side wall component is easily folded and stacked on the back case component without the support of the fold-resisting component.

In some embodiments, the first combination component and the second combination component are two attached components with hooks and loops (such as Velcro®). When the user folds the sidewall parts, the extension part of the fold-resisting component is separated from the link-up section of the bending part automatically at the same time. Accordingly, the folding suitcase is able to be folded easily and conveniently.

In some embodiments, since the restoring component is disposed on the peripheral side wall component, the folding suitcase is able to be automatically unfolded by the elasticity of the restoring component. Thus, the user does not need to erect the sidewall parts manually such that the folding suitcase is able to be unfolded easily and conveniently.

The disclosure will become more fully understood from the said embodiment for illustration only and thus does not limit the disclosure. Any modifications within the spirit and category of the disclosure fall in the scope of the disclosure.

What is claimed is:

1. A folding suitcase, comprising:

a back case component;

a front lid component;

a peripheral side wall component with two sides which are opposite to each other, an edge of the back case component and an edge of the front lid component being connected to the two sides of the peripheral side wall component respectively, thereby forming an accommodating space which is for being covered selectively, the peripheral side wall component having a plurality of first sidewall parts, a plurality of second sidewall parts and a plurality of bending parts connected to the plurality of first sidewall parts and the plurality of second sidewall parts, and the plurality of bending parts being bendable to allow the plurality of first sidewall parts and the plurality of second sidewall parts to be folded oppositely or erected on the back case component, each of the plurality of bending parts comprising a bending section and a link-up section, the plurality of bending sections being connected to the plurality of first sidewall parts, and the link-up section of each of the plurality of bending parts being connected to the plurality of second sidewall parts;

at least one fold-resisting component, the at least one fold-resisting component being elastic and comprising a combined part and an extension part which are connected to each other, the combined part being disposed at one of the plurality of first sidewall parts;

two bendable fixing components, each of the two bendable fixing component having a fixing section and a suspension section which are connected with each other, the two fixing sections being located on two of the plurality of second sidewall parts of the peripheral side wall component, respectively, the two suspension sections being disposed across the bending sections of the bending parts, respectively;

two restoring components, located at an inner side of the peripheral side wall component by the two bendable fixing components respectively with each of the restoring components being disposed across at least one bending part, the two restoring components being elastic, and an elasticity of the at least one fold-resisting component being greater than an elasticity of the two restoring components;

an elastic component, the two suspension sections being connected to two ends of the elastic component, respectively;

a first combination component, disposed at the bending part close to the first sidewall part at which the combined part is disposed; and a second combination component, disposed at the extension part of the at least one fold-resisting component, the extension part of the at least one fold-resisting component being detachably disposed at the link-up section by the first combination component and the second combination component, such that the fold-resisting component is disposed across the bending section, the first combination component and the second combination component being two attached components with hooks and loops and the first combination component being detachably combined with the second combination component.

2. The folding suitcase according to claim 1, wherein the plurality of first sidewall parts and the plurality of second sidewall parts are for bending relative to the bending section, such that at least one fold line is formed at the plurality of bending sections and the plurality of link-up sections, and the at least one fold-resisting component is disposed across the fold line of the bending section.

3. The folding suitcase according to claim 1, wherein the first combination component is disposed at the link-up section of one of the bending parts.

4. The folding suitcase according to claim 1, wherein a width of a side of each first sidewall part close to the back case component is greater than a width of a side of each first sidewall part away from the back case component.

5. The folding suitcase according to claim 1, wherein the restoring component is located on a side of the peripheral side wall component which is away from the back case component.

6. The folding suitcase according to claim 1, wherein the restoring component comprises two connection sections and an elastic section with two sides which are opposite to each other, the two connection sections are connected to the two sides of the elastic section and disposed at the first sidewall part and second sidewall part which are adjacent to each other, and the elastic section is disposed at the bending part.

7. The folding suitcase according to claim 1, wherein the restoring component is a helical spring or an elastic strip.

8. The folding suitcase according to claim 1, wherein the restoring component is for storing an elastic potential energy when the plurality of first sidewall parts and the plurality of second sidewall parts are away from being erected, and the plurality of first sidewall parts and the plurality of second sidewall parts are simultaneously driven to erect by the restoring component when the elastic potential energy is released.

9. The folding suitcase according to claim 1, wherein the quantity of the at least one fold-resisting component is greater than one, and the plurality of combined parts of the plurality of fold-resisting components are disposed on the plurality of first sidewall parts.

* * * * *